US005669733A

United States Patent [19]

Daly et al.

[11] Patent Number: 5,669,733

[45] Date of Patent: Sep. 23, 1997

[54] ANGLED ADAPTER FOR A LEACHING CHAMBER SYSTEM

[75] Inventors: Frank J. Daly, Cheshire, Conn.; Douglas O. Hamilton, Findlay; H. John Sidaway, McComb, both of Ohio

[73] Assignee: Hancor, Inc., Findlay, Ohio

[21] Appl. No.: 414,932

[22] Filed: Mar. 31, 1995

Related U.S. Application Data

[63] Continuation-in-part of Ser. No. 299,828, Sep. 1, 1994, Pat. No. 5,556,231.

[51] Int. Cl.[6] ..... E02B 13/00

[52] U.S. Cl. ..... 405/48; 405/43; 405/46; 405/49; 138/105; 138/155

[58] Field of Search ..... 405/43–51, 121, 405/118–120, 124, 126; 138/105, 155; 285/179

[56] References Cited

U.S. PATENT DOCUMENTS

| | | | |
|---|---|---|---|
| D. 329,684 | 9/1992 | Gray | D23/207 |
| 460,352 | 9/1891 | Reading . | |
| 680,548 | 8/1901 | Sikes . | |
| 980,442 | 1/1911 | Schlafly . | |
| 1,518,014 | 12/1924 | Steen | 405/47 |
| 2,153,789 | 4/1939 | Carswell et al. | 61/13 |
| 2,366,522 | 1/1945 | Gutman | 61/10 |
| 2,518,292 | 8/1950 | De Anglis | 405/47 |
| 2,802,339 | 8/1957 | Fogerty | 405/47 |
| 2,866,319 | 12/1958 | Nicholson | 61/11 |
| 3,333,422 | 8/1967 | Neyland | 61/13 |
| 3,440,823 | 4/1969 | Olsen | 61/11 |
| 3,495,410 | 2/1970 | Bailey et al. | 61/11 |
| 3,570,251 | 3/1971 | Roberts | 61/10 |
| 3,579,995 | 5/1971 | Flynn | 61/13 |
| 3,645,100 | 2/1972 | LaMonica | 61/13 |
| 4,245,924 | 1/1981 | Fouss et al. | 405/45 |
| 4,360,042 | 11/1982 | Fouss et al. | 138/119 |
| 4,523,613 | 6/1985 | Fouss et al. | 138/121 |
| 4,759,661 | 7/1988 | Nichols et al. | 405/48 |
| 4,854,775 | 8/1989 | Lockwood | 405/126 |
| 5,017,041 | 5/1991 | Nichols | 405/48 |
| 5,087,151 | 2/1992 | DiTullio . | |
| 5,156,488 | 10/1992 | Nichols | 405/48 |

FOREIGN PATENT DOCUMENTS

| | | | |
|---|---|---|---|
| 2124277 | 2/1984 | United Kingdom | 405/126 |

OTHER PUBLICATIONS

Hancor, Inc. "Channel–Flow Plastic Tubing".

"Flared End Section" (New Product Announcement), Hancor, Inc. 1992.

"The No Gravel Leaching Field System You Can Haul in One Truck", The Infiltrator Advertisement & Technical Support Paper, Apr. 1987.

*Primary Examiner*—Tamara L. Graysay
*Assistant Examiner*—Frederick L. Lagman
*Attorney, Agent, or Firm*—Fay, Sharpe, Beall, Fagan, Minnich & McKee

[57] ABSTRACT

A leaching system (10) includes arched leaching chamber sections (12) and an angled adapter (18) connected adjacent chamber sections at a 22.5° angle. The adapter includes a first portion (122) having sidewalls (140, 142) spanned by a vaulted portion (144) and a female end collar (126). A second end portion (124) has sidewalls (140, 142) spanned by a vaulted portion (144) and a male end collar (130). The first and second end portions are connected at an arched, vertical ridge (136). The adapter connects the leaching chamber sections in a nonlinear configuration to curve the leaching system to follow contours and avoid obstacles.

18 Claims, 6 Drawing Sheets

ANGLED ADAPTER FOR A LEACHING CHAMBER SYSTEM

This application is a continuation-in-part of U.S. application Ser. No. 08/299,828, filed Sep. 1, 1994, now U.S. Pat. No. 5,556,231 for a "Severable Leaching Chamber With End Cap".

BACKGROUND OF THE INVENTION

The present invention pertains to the drainage arts. It finds particular application in leaching fields and will be described with particular reference thereto. However, it is to be appreciated that the present invention will also find application in conjunction with storm water dispersions and other types of water and liquid handling systems.

Typically, when leaching fields are utilized for drainage, effluent (a term commonly used for waste materials such as liquid industrial refuse or sewage which flow out of a source and are discharged into the environment) is carried from its source to the leaching field for dispersion, or percolation, into surrounding soil. Pipes that carry the effluent discharge the material into a chamber, or vault. Perforated conduit sections leading from the chamber are usually buried in a trench to facilitate dispersion of the effluent into the soil. In some systems, the chamber is defined by large diameter conduit. In other systems, the chamber is perforated to provide direct dispersion. The effluent is then dispersed into the soil either through the soil serving as the floor of the chamber or, when effluent accumulates in the chamber, through passages in sidewalls of the chamber.

Prior art leaching conduits are commonly formed of plastic resin material and corrugated for strength. These conduits are formed in sections which are mated to define the effective length of the leach field. Direct leaching chambers are also connected to increase the length and capacity of the leach field.

One difficulty encountered by installers of leaching conduits is avoiding obstructions such as trees, hydrants, and the like. When leaching chambers could not be laid in a straight line, discrete and separated chambers were connected by smaller diameter e.g., four inch, corrugated tubing lengths. Such constructions retard uniform flow and liquid dispersion.

The present invention contemplates a new and improved leaching chamber which resolves the above-referenced difficulties and others.

SUMMARY OF THE INVENTION

In accordance with the present invention, an angled adapter connects chamber sections in a leaching system. The angle adapter has a first side portion connected to a second portion at an angle.

In accordance with one aspect of the present invention, a ridge connects the first and second side portions such that 1) sidewalls and vaulted portions of the side portions are respectively aligned, 2) the ends of the adapter terminate in collars or connectors for attachment with other adapters, chambers, or the like, and 3) the collars are nonparallel to one another.

In accordance with another aspect of the invention, the sidewalls of the side portions include liquid dispersion louvers.

In accordance with another aspect of the present invention, the end collars are disposed at an angle of 22.5° to one another.

One advantage of the present invention is that the leaching system can be configured so that the flow direction of the chambers can be turned, jogged or otherwise adapted to avoid obstructions in the field.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
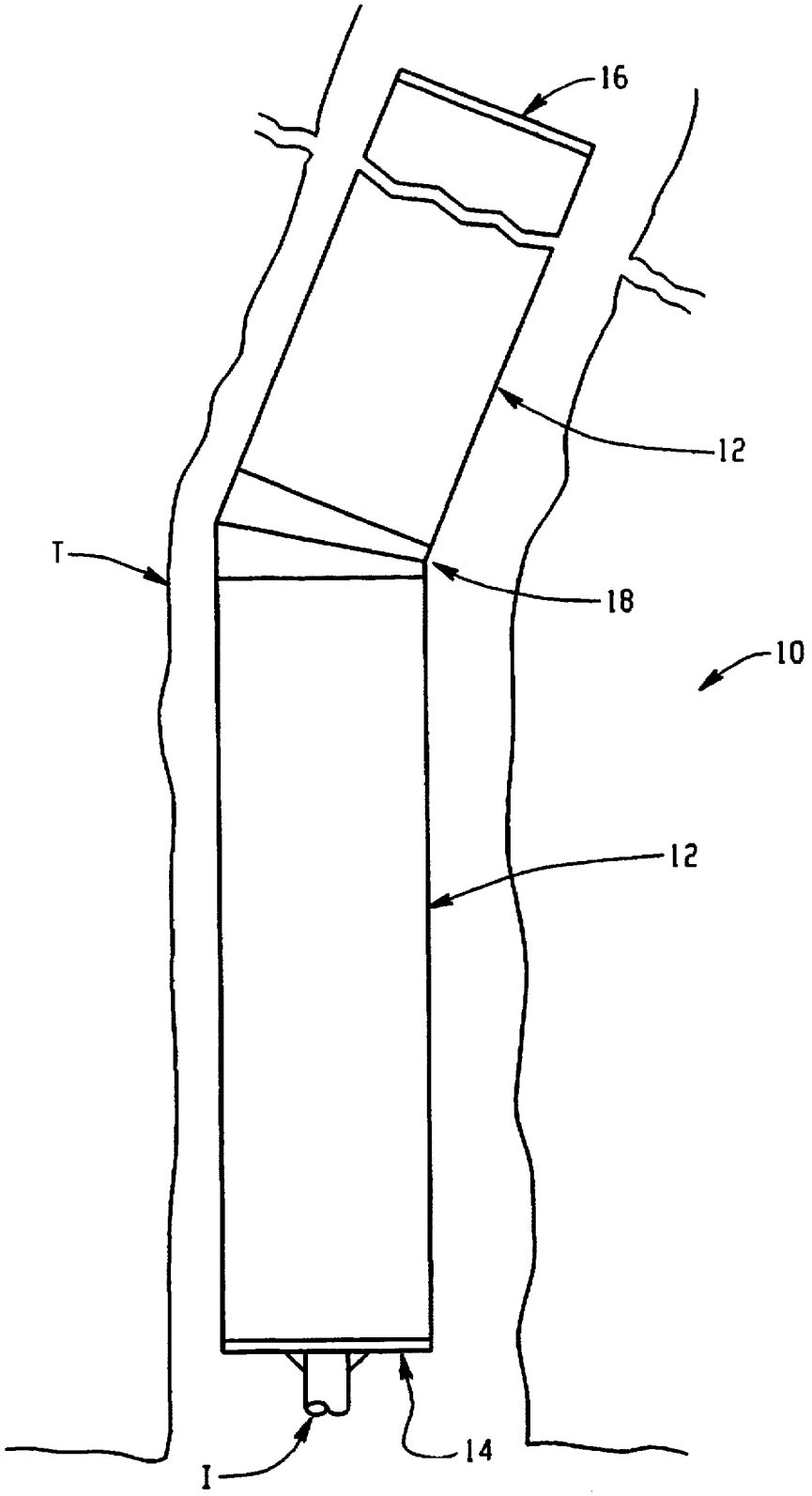
FIG. 1 is a simplified top plan view of a leaching system of the present invention.

With reference to FIG. 1, wherein components are illustrated in highly simplified form, a leaching system 10 includes molded, polyethylene chamber or vault portions 12, an inlet end cap 14, and a closed end cap 16. The end caps 14 and 16 are releasably mounted at opposite ends of the chamber portions 12 which are matingly connected by an angled adapter 18 to alter the flow direction of the chamber portions in the preferred embodiment of the invention. The chamber portions 12 can also be matingly connected with additional chamber portions to increase the length of the leaching chamber 10 as a whole. Moreover, additional adapters 16 may be used to turn, jog, or otherwise adjust the configuration of the system.

The leaching chambers 12 and the adapter and any additional mated chamber portions, are particularly suited to be positioned in a drainage trench T with open end down, creating a vault or chamber for drainage. An inlet conduit I which supplies effluent is received in the inlet end cap 14. Soil or gravel is preferably placed on and around the system 10 to promote dispersion. Preferably the chamber is buried at least a foot below ground level.

Figure 2:
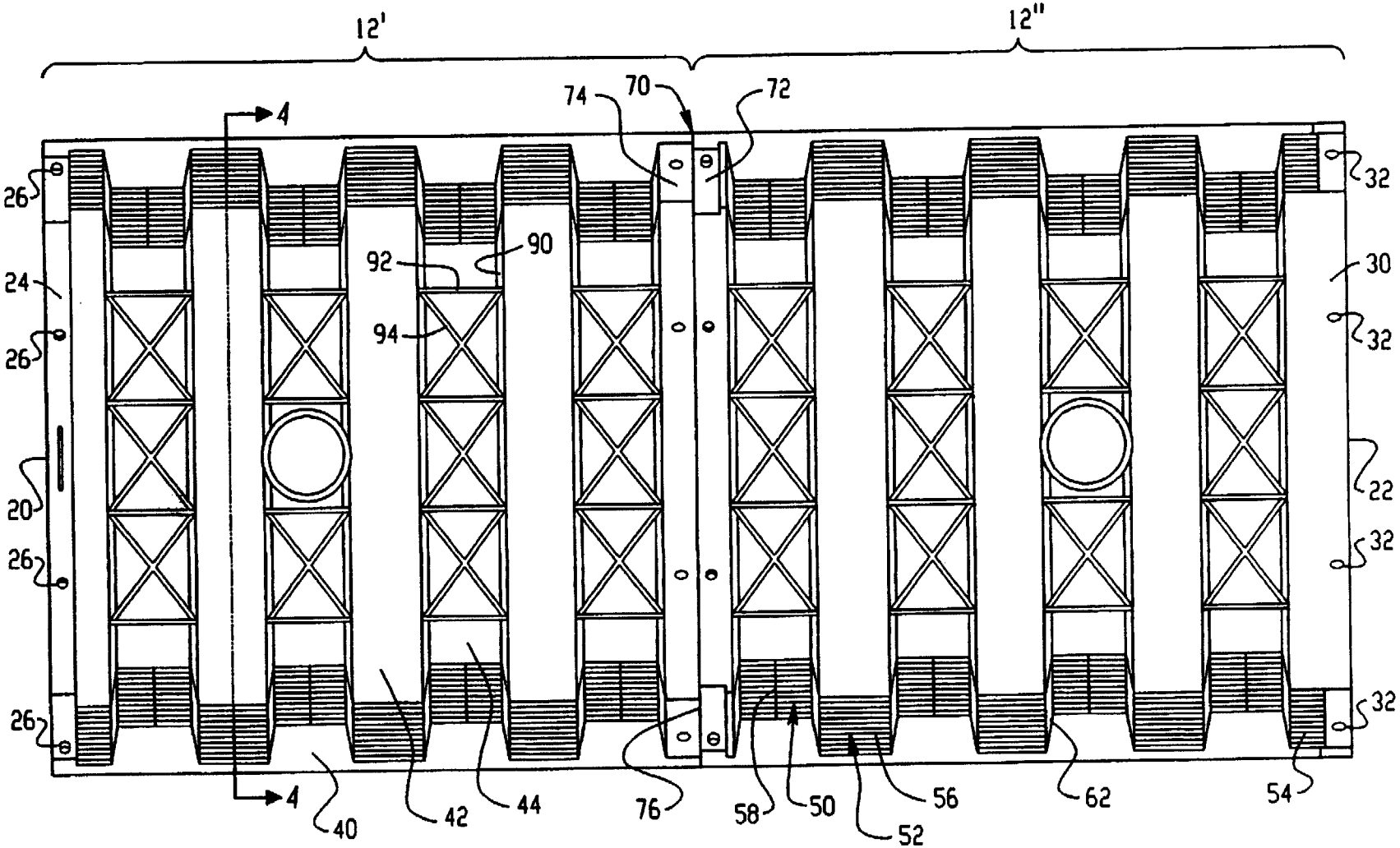
FIG. 2 is a top view of the chamber portion of the leaching system of FIG. 1.
Figure 3:
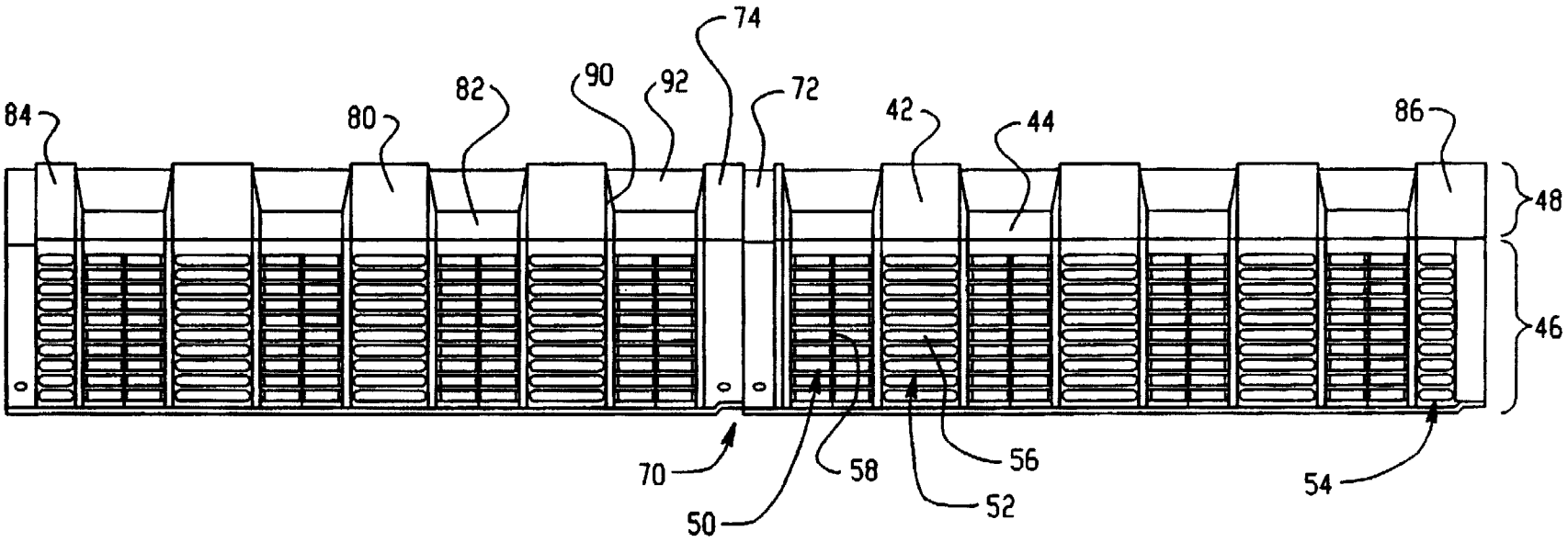
FIG. 3 is a side view of the chamber portion of the leaching system of FIG. 1.
Figure 4:
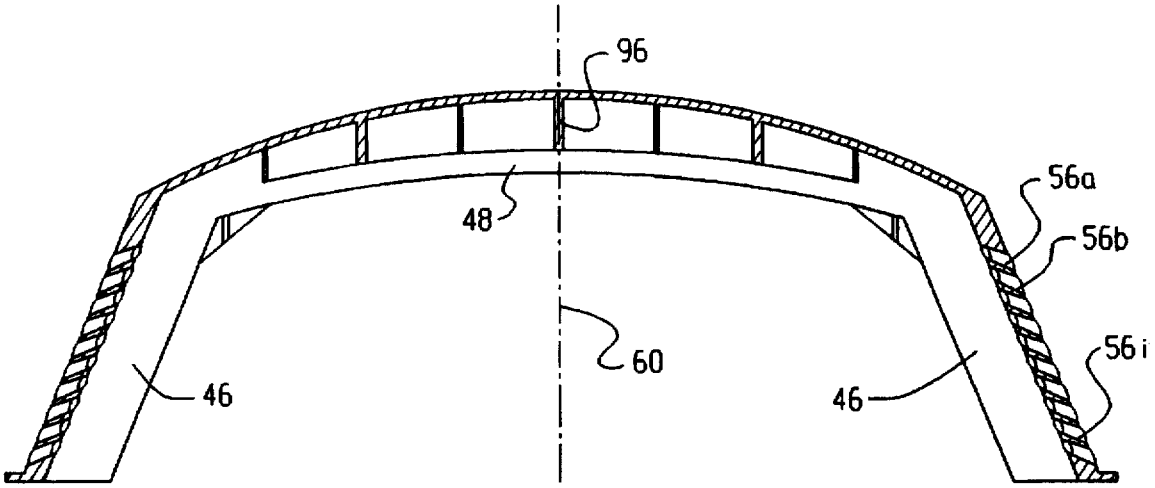
FIG. 4 is an enlarged cross sectional view along section 4—4 of FIG. 2.

Referring now more particularly to FIGS. 2, 3 and 4, an exemplary chamber portion 12 includes a first end 20 and a second end 22. The first end 20 includes a first end male coupling collar 24 which is circumferentially disposed about the first end 20 to conform generally with the cross-sectional shape (FIG. 4) of the chamber portion 12. The first end collar 24 has knob-like protrusions 26 disposed thereon. The protrusions facilitate mating assembly with either the inlet end cap 14 or the opposite end of an additional chamber portion. The second end 22 includes a second end female coupling collar 30 which has apertures or larger protrusions 32 which matingly engage corresponding protrusions 26 on the male coupling collar 24 of a next adjacent coupled chamber portion or an end cap. Like first or male collar 24, second or female collar 30 generally conforms to the cross sectional shape (FIG. 4) of the chamber 12.

Various numbers and placements of the protrusions and the protrusion receiving apertures or larger protrusions on the first end, second end, and the end caps (which include end collars corresponding to the chamber portions) are, of course, contemplated. For example, apertures are alternatively placed on the first end and protrusions on the second end and the end cap. Further, the protrusions may be placed on the inside or outside surface of the respective component and the apertures may be through-holes or simply suitably sized indentations or protrusions. Moreover, apertures (or protrusions) may be placed on both the first and second ends so long as a corresponding chamber portion 12 includes protrusions (or apertures) on both ends for mating. Other mechanical interconnection mechanisms, both integrally molded and separately attached, are also contemplated.

The chamber portion 12 includes base surfaces or foot portions 40. Corrugations having alternating peak portions 42 and valley portions 44 extend between the foot portions. The peaks and valleys have lower, sidewalls 46 extending linearly upward from the foot portions 40 toward an apex area. A corrugated top wall or vault 48 connects opposite sidewalls 46.

The sidewalls 46 comprise inner louver sections 50, outer louver sections 52, and end louver sections 54. Each louver section includes a plurality of louvers 56 defining dispersion apertures and disposed parallel to one another and suitably spaced and angled to allow drainage in one direction yet inhibit an influx of soil or gravel in the other direction.

The inner louver sections 50 further include support rails 58, to enhance rigidity of the chamber portion 12. The end louver sections 54 are similar to the other louver sections except that they are approximately one-half (½) the length of the other louver sections. The end louver sections are disposed on half of end peaks adjacent the end collars 22, 30 to facilitate mating with respective end caps or other chambers.

The louver sections allow effluent to pass from the inside of the chamber portion 12 to the outside of the chamber portion 12 to be absorbed in surrounding soil. Accordingly, as shown in FIG. 4, each louver section is disposed on an angle with respect to a central vertical axis 60 of the chamber 12. When the chamber 12 is installed in a drainage trench, the top louvers of each section are a smaller distance from the vertical axis than the bottom louvers. For example, louver 56*a* is a smaller distance from vertical axis than louver 56*i*. This arrangement allows for drainage of the effluent out of the chamber portion 12 and inhibits influx of soil or gravel into the chamber portion As those skilled in the art will appreciate, effluent flowing over the upper most louver 56*a* will pass over the end of upper most louver 56*a* on to the top surface of the next louver 56*b* therebelow and eventually drain into the soil.

As illustrated in FIGS. 2 and 3, the louver sections are generally rectangular and disposed parallel to one another but are alternatingly offset from one another. The arrangement is such that each louver section is offset from each adjacent louver section thereto by a set distance. Vertical connecting webs or corrugation edge walls 62 are provided to connect adjacent louver sections. The connecting webs converge inward from the peaks to the valleys.

A central, or intermediate, corrugation peak, or support structure, 70 includes a first portion 72 which is substantially identical to the first end collar 20 and a second portion 74 that is substantially identical to the second end collar 30.

The central corrugation peak 70 not only provides support for the chamber 12, but also provides a mechanism for separating the chamber 12 into two identical components or subchambers 12' and 12". The integrally formed first and second portions 72, 74 are cut through center line 76. Once separation is accomplished, the two identical sub-chamber portions 12' and 12" are formed. The first sub-chamber portion 12' includes a first or male collar 24 at the first end 20 and a second or female coupling collar 74 at the other end 74. The second sub-chamber portion 12" includes the female coupling collar 30 at the second end 22 and the male or first coupling collar 72 at the other end. As can be seen, each sub-chamber is merely a smaller version of the chamber portion 12. Alternately, an increased number of intermediate male/female coupling peaks 70 may be disposed throughout the chamber portion 12 to facilitate separation of the chamber 10 into an increased number of subchambers.

With reference to FIG. 4, the sidewalls 46 are connected by vaulted portion 48 to form the vault or chamber. As shown in FIG. 3, the vaulted portion 48 includes vault peak 80 and valley portions 82. End peak portions 84 and 86 are only one-half (½) the size of the others. The vault peak portions align with the outer louver sections 52 which do not include supporting rails, as shown in FIGS. 2 and 3, and the vault valley portions align with the inner louver sections 50 having the supporting rails. In this arrangement, a combination of the staggered sidewalls, having louver sections and the corrugated vaulted portion provides a corrugated support structure for the chamber portion 12. As can be seen in FIGS. 2 and 3, the corrugation includes alternating support structures wherein the support structures of the raised portions have a greater cross-sectional area than the support structures of the lower portions.

The first and second connection collars 24, 30 are preferably disposed on the peak portions, rather than the valley portions. The first or male collar is offset from the peak portion by the thickness of the plastic in the collar portions. The second or female collar is flush with the peak portion. This arrangement has advantages in that a maximum measurable volume of the chamber 12 is obtained, as will be described in greater detail below.

With reference to FIGS. 2 and 3, the peak portions 82 of the vaulted portion have edge walls 90. Longitudinal ribs 92 extend between the peak edge walls 90 to inhibit longitudinal distortion. Crossed ribs 94 inhibit twisting. While this specific webbing configuration (more completely shown in FIG. 1) is shown in FIGS. 2 and 3, other suitable alternative configurations which provide like support are recognized as falling within the spirit and scope of the invention. Additional ribs 96 (FIG. 4) are integrally molded under the vault peak portions.

Figure 5:
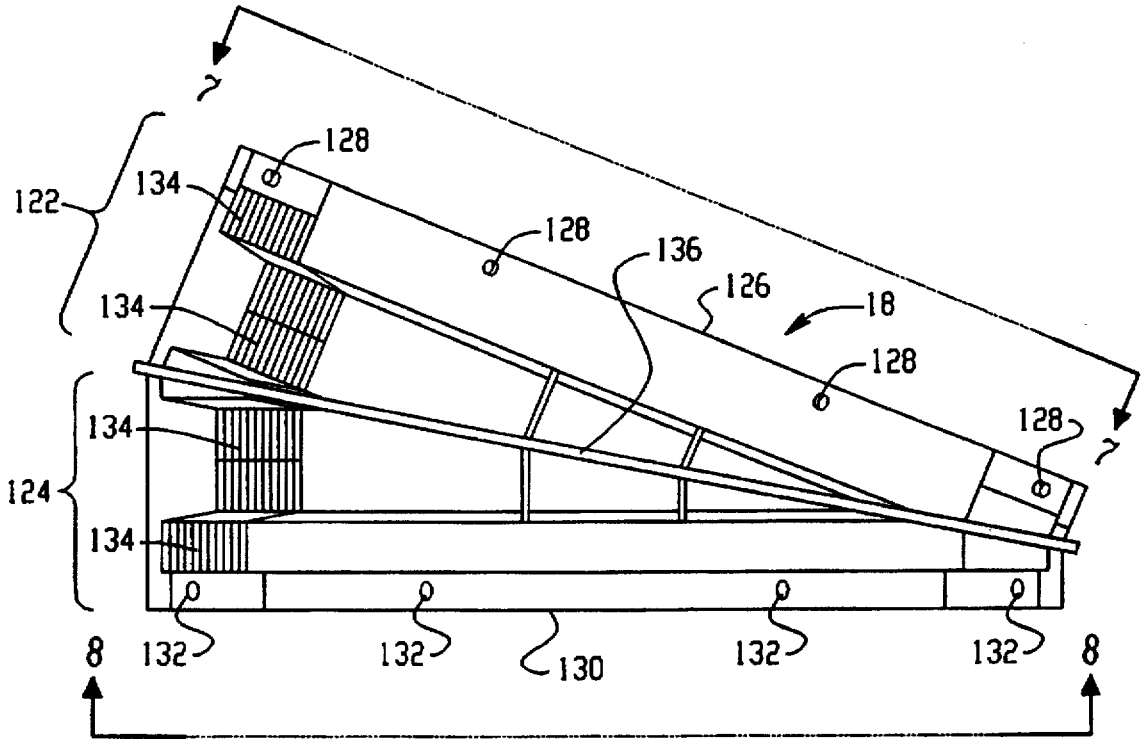
FIG. 5 is a top view of an angled adapter according to the present invention.

Referring now to FIG. 5, the angled adapter 18 includes female end portion 122 and male end portion 124. The end portion 122 includes a female collar 126 having knoblike protrusions 128 circumferentially disposed therearound. The female collar 126 is similar to the female collar 30 of the chamber 10 in that it is sized to receive male collar 24. Likewise, the end portion 124 includes a male collar 130 having apertures or protrusions 132 circumferentially disposed therearound. The male collar 130 is similar to the male collar 24 of the chamber sections 12 in that it cooperatively engages collar 30. With this arrangement, the adapter is engageable with either end of the chamber sections 12. Of course, the collars are reversed if it is desired to have the adapter provide a curve in the other direction.

Each portion 122 and 124 is tapered and connected to the other along ridge 136 so that the combination of each portion provides an angle of 22.5° between the collars 126 and 130 of the adapter 18. The preferred angle of 22.5° may vary depending on the preference of the user. This configuration provides an angle of 157.5° between central, longitudinal axis conduit sections mated to the adapter 18, i.e., a 22.5° jog from straight ahead.

FIG. 5 illustrates an adapter which, when connected to the collar 30 provides a change of flow direction to the right as effluent flows from the chamber section 12 into the adapter 18. However, if the adapter 18 is connected to the collar 24, the change of flow direction is to the left. To obtain opposite results, i.e., change flow direction to the right when connected to collar 24 and change direction to the left when connected to collar 30, an identical adapter (not shown) having collars 126 and 130 interchanged is preferably provided.

Figure 6:
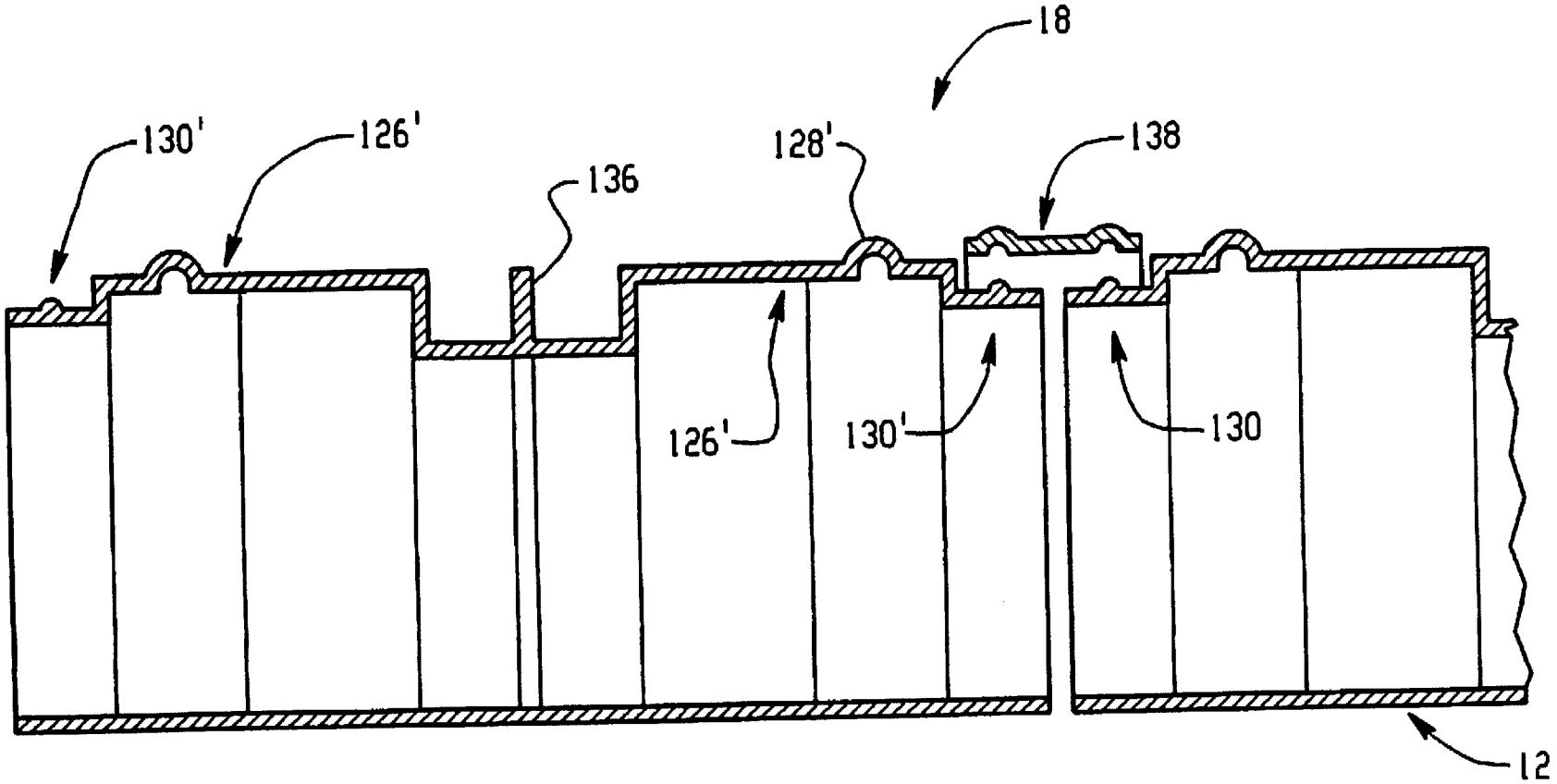
FIG. 6 is a side sectional simplified view of an alternate, reversible embodiment of the adapter.

Alternatively, an adapter having identical end collars compatible with both end collars 24 and 30 is contemplated. For example, with reference to FIG. 6, the end collars of the adapter may be extended and telescoped into subcollars to resemble intermediate peak 70. In this way, a male subcollar 130' is disposed farther from the ridge 136 than an adjacent female subcollar 126'. The subcollar positioned closer to ridge 136 has a larger radius than the other subcollar. With this double male adapter, the installer cuts off and discards the male subcollar 130' from the appropriate end. Alternately, a U-shaped coupling collar 138 can be snapped over the male connection between one end of the coupler and an adjoining chamber or another coupler. Thus, only one type of adapter would be needed to change flow direction regardless of whether end collar 24 or 30 was available for connection.

As shown, the adapter coupler 18 includes louver sections 134. As a result of the tapering of the adapter, only one side of the adapter includes louver sections in the preferred embodiment. These sections operate in the same way as the louver sections of the chamber 10.

Figure 7:
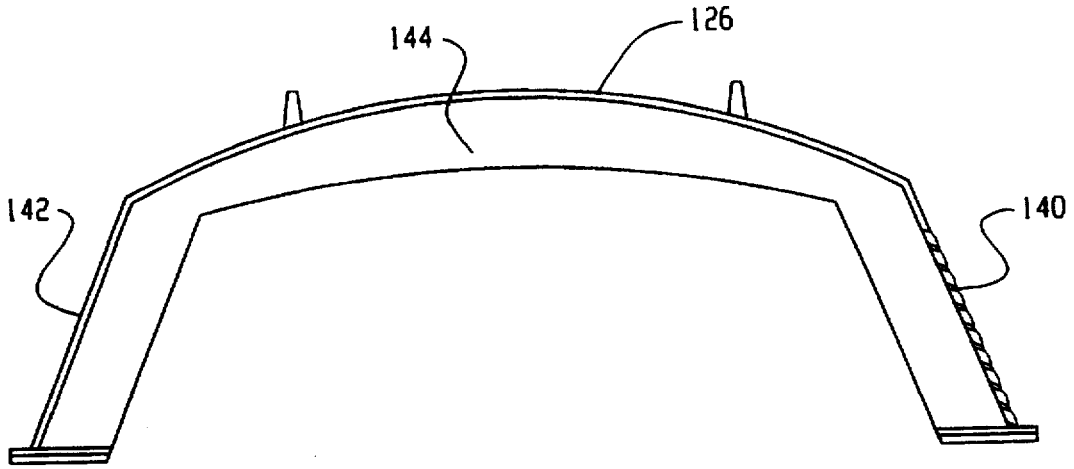
FIG. 7 is an end view of the adapter of FIG. 5 from direction 7—7.
Figure 8:
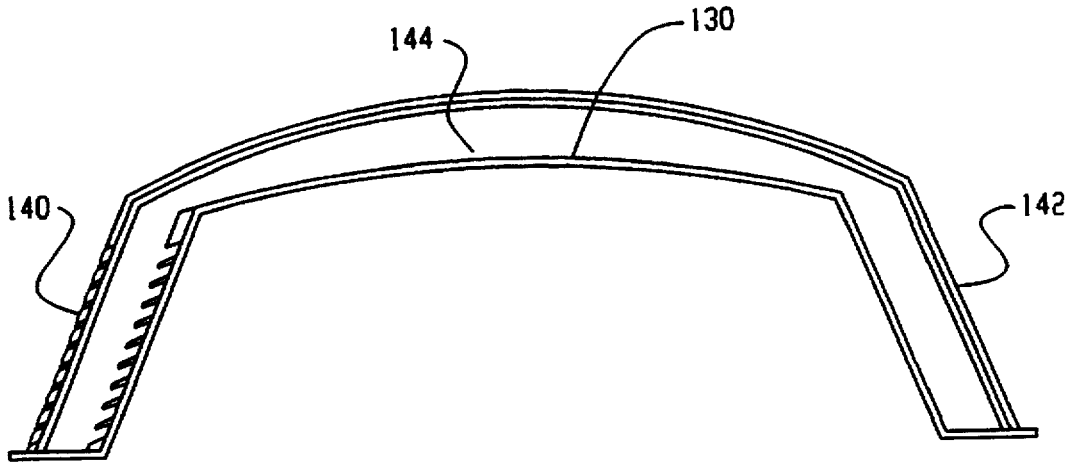
FIG. 8 is an end view of the adapter of FIG. 5 from direction 8—8.

Similarly, as shown in FIG. 7 and 8, the adapter 18 has end profiles identical to those of the chamber portion 12. Specifically, the end portions 122 and 124 each have sidewalls 140 and 142 and a vaulted portion 144. The identical profiles facilitate mating of the adapter 18 to the chamber sections 12.

In one embodiment, the adapter coupler 18 is formed by suitably cutting ends, including collars 24 and 30, away from one chamber section 12. The cut ends are then welded together along the ridge 136 to form the adapter coupler 18. This process of formation facilitates ready changes in the angle and the length of each of the end portions 122 and 124 of the adapter. It is appreciated that the end portions could be increased in length by such a degree so as to include louver sections on both sides of the adapter, not just one.

Alternatively, the adapter 18 may be formed by injection molding. In this instance, suitable molds and known techniques are used. However, variations in angles and lengths are accomplished by using separate molds.

The 22.5° angle is ideal because it changes the liquid flow direction gently with a minimum of turbulence. In many applications, a jog in one direction is soon followed by a jog back in the original direction. In other applications, the chamber system (possibly a series a generally parallel lines of chambers) meanders to conform to the contours of the terrain and obstructions. The 22.5° angle is particularly advantageous in that the adapter couplers can be chained to create 45°–90°, and other common angles.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. In a leaching system having a plurality of buried leaching chambers connected to receive effluent and disperse the effluent into surrounding soil, each chamber being generally U-shaped and installed with an open side down and having a generally U-shaped male end collar and a generally U-shaped female end collar, the male and female end collars of each chamber being matable with the female and male end collars, respectively of other chambers, the improvement comprising:

an adapter section having generally U-shaped first and second end portions with open sides down and an arch-shaped ridge disposed therebetween, the first end portion having a generally U-shaped adapter section male end collar and the second end portion having a generally U-shaped adapter section female end collar, the adapter section male and female end collars being angled such that one chamber whose male end collar is connected with the adapter section female end collar is offset relative to another chamber whose female end collar is connected with the adapter section male end collar.

2. The adapter section as set forth in claim 1 wherein the one chamber is offset by an angle of 157.5° relative to the another chamber.

3. In a leaching system having a plurality of buried leaching chambers connected to receive effluent and disperse the effluent into surrounding soil, each chamber being generally U-shaped and installed with an open side down and having a generally U-shaped male end collar and a generally U-shaped female end collar, the male and female end collars of each chamber being matable with the female and male end collars, respectively of other chambers, the improvement comprising:

an adapter section having generally U-shaped first and second end portions with open sides down, the first end portion having a generally U-shaped adapter section male end collar and the second end portion having a generally U-shaped adapter section female end collar, the adapter section male and female end collars being angled such that one chamber whose male end collar is connected with the adapter section female end collar is offset relative to another chamber whose female end collar is connected with the adapter section male end collar, and the first and second end portions having louvers defined therein.

4. In a leaching system having a plurality of buried leaching chambers connected to receive effluent and disperse the effluent into surrounding soil, each chamber being generally U-shaped and installed with an open side down and having a generally U-shaped male end collar and a generally U-shaped female end collar, the male and female end collars of each chamber being matable with the female and male end collars, respectively of other chambers, the improvement comprising:

an adapter section having generally U-shaped first and second end portions with open sides down, the first end portion having a generally U-shaped adapter section male end collar and the second end portion having a generally U-shaped adapter section female end collar, the adapter section male and female end collars being angled such that one chamber whose male end collar is connected with the adapter section female end collar is offset relative to another chamber whose female end collar is connected with the adapter section male end collar, and the first and second end portions having fluid discharge openings defined therein.

5. An angled adapter for use in a leaching system to alter a direction of flow in the system, the system including a plurality of arched leaching chambers with open bases connected end to end, the adapter comprising:

a first arched end portion having a pair of first sidewalls spanned by a first vaulted portion and a male end collar having a shape contoured to the first and second sidewalls and first vaulted portion and configured for interconnection with a female end collar of one of the leaching chambers;

a second arched end portion having a pair of second sidewalls spanned by a second vaulted portion and a female end collar having a shape contoured to the third and fourth sidewalls and second vaulted portion and configured for interconnection with a male end collar of another of the leaching chambers;

the first and second arched end portions having fluid discharge openings defined therein and being interconnected such that 1) the adapter terminates at the male end collar at one end and terminates at the female end collar at a second end and 2) the female and male end collars are nonparallel to one another.

6. The adapter as set forth in claim 5 wherein the male and female end collars are disposed at an angle of 22.5° to one another.

7. The adapter as set forth in claim 5 wherein the first end portion further includes a female end collar and the second end portion includes a male end collar, the male collar being removed from one of the first and second end portions to select an orientation of the adapter, whereby the adapter is reversible.

8. The adapter as set forth in claim 5 wherein the adapter is reversible to define a jog to the right in one orientation and a jog to the left in another orientation.

9. An angled adapter for use in a leaching system to alter a direction of flow in the system, the system including a plurality of arched leaching chambers with open bases connected end to end, the adapter comprising:

a first arched end portion having a pair of first sidewalls spanned by a first vaulted portion and a male end collar having a shape contoured to the first and second sidewalls and first vaulted portion and configured for interconnection with a female end collar of one of the leaching chambers;

a second arched end portion having a pair of second sidewalls spanned by a second vaulted portion and a female end collar having a shape contoured to the third and fourth sidewalls and second vaulted portion and configured for interconnection with a male end collar of another of the leaching chambers;

the first and second arched end portions being interconnected such that 1) the adapter terminates at the male end collar at one end and terminates at the female end collar at a second end and 2) the female and male end collars are nonparallel to one another; and, an arch shaped ridge connected between the first and second end portions.

10. The adapter as set forth in claim 9 wherein the ridge includes a weld joint between the first and second arched end portions.

11. An angled adapter for use in a leaching system to alter a direction of flow in the system, the system including a plurality of arched leaching chambers with open bases connected end to end, the adapter comprising:

a first arched end portion having a pair of first sidewalls spanned by a first vaulted portion and a male end collar having a shape contoured to the first and second sidewalls and first vaulted portion and configured for interconnection with a female end collar of one of the leaching chambers;

a second arched end portion having a pair of second sidewalls spanned by a second vaulted portion and a female end collar having a shape contoured to the third and fourth sidewalls and second vaulted portion and configured for interconnection with a male end collar of another of the leaching chambers;

the first and second arched end portions being interconnected such that 1) the adapter terminates at the male end collar at one end and terminates at the female end collar at a second end and 2) the female and male end collars are nonparallel to one another; and, the first and second sidewalls including louvers.

12. A leaching system comprising:

a first open based chamber section having opposite ends;

a second chamber section having opposite ends;

an adapter connecting ends of the first and second chamber sections, the adapter including, a first end portion having first sidewalls spanned by a first vaulted portion and a first end coupling collar connected with one end of the first chamber section;

a second end portion having second sidewalls spanned by a second vaulted portion and a second end collar connected with one end of the second chamber section;

the first and second end portions being connected such that 1) the first and second sidewalls, and the first and second vaulted portions, respectively abut, and 2) the first and second end collars are nonparallel to one another, such that the first and second chamber sections are connected at an angle to each other; and, the first and second sidewalls of the adapter including louvers.

13. A leaching system comprising:

a first open based chamber section having opposite ends;

a second chamber section having opposite ends;

an adapter connecting ends of the first and second chamber sections, the adapter including, a first end portion having first sidewalls spanned by a first vaulted portion and a first end coupling collar connected with one end of the first chamber section;

a second end portion having second sidewalls spanned by a second vaulted portion and a second end collar connected with one end of the second chamber section;

the first and second end portions being connected such that 1) the first and second sidewalls, and the first and second vaulted portions, respectively abut, and 2) the first and second end collars are nonparallel to one another, such that the first and second chamber sections are connected at an angle to each other; and, a ridge connected between the first and second end portions.

14. The system as set forth in claim 13 wherein the first and second end collars of the adapter are disposed at an angle of 22.5° to one another such that the first and second chambers turn 22.5° from straight ahead.

15. The system as set forth in claim 13 wherein the first end collar is a male collar that is connected with a female end collar of the first chamber section and the second end collar is a female end collar that is connected to a male end collar of the second chamber section.

16. The system as set forth in claim 13 wherein the second end collar is connectable with the end of the first chamber section and the first end collar is connectable with the end of the second chamber section.

17. The system as set forth in claim 13 wherein the adapter is reversible.

18. The system as set forth in claim 13 further including apertures in the first and second side walls of the adapter.

* * * * *